US006634626B2

(12) United States Patent
Petrescu et al.

(10) Patent No.: US 6,634,626 B2
(45) Date of Patent: Oct. 21, 2003

(54) HORIZONTAL SURFACE AERATOR

(75) Inventors: Catalin Petrescu, Eden Prairie, MN (US); Peter S. Gross, Plymouth, MN (US)

(73) Assignee: Aeromix Systems, Inc., Minneapolis, MN (US)

( * ) Notice: Subject to any disclaimer, the term of this patent is extended or adjusted under 35 U.S.C. 154(b) by 97 days.

(21) Appl. No.: 09/927,152

(22) Filed: Aug. 10, 2001

(65) Prior Publication Data

US 2003/0030157 A1 Feb. 13, 2003

(51) Int. Cl.[7] ..... B01F 3/04
(52) U.S. Cl. ..... 261/92; 261/120; 210/242.2
(58) Field of Search ..... 261/92, 120; 210/219, 210/242.2

(56) References Cited

U.S. PATENT DOCUMENTS

| | | | | | |
|---|---|---|---|---|---|
| 3,322,410 | A | * | 5/1967 | Ahlenius | 261/92 |
| 3,458,176 | A | * | 7/1969 | Auler | 261/92 |
| 3,561,738 | A | | 2/1971 | Galeano | 261/92 |
| 3,595,538 | A | | 7/1971 | Baumann | 261/92 |
| 3,658,305 | A | * | 4/1972 | Newtson | 261/92 |
| 3,759,495 | A | | 9/1973 | Boler et al. | 261/92 |
| 3,846,517 | A | * | 11/1974 | Ross | 261/120 |
| 3,960,991 | A | | 6/1976 | Schmitt et al. | 261/92 |
| 4,190,619 | A | | 2/1980 | Cherne | 261/92 |
| 4,364,826 | A | | 12/1982 | Kato | 210/150 |
| 4,409,107 | A | | 10/1983 | Busch | 210/758 |
| 4,904,420 | A | | 2/1990 | Cornelissen | 261/92 |
| 4,908,131 | A | | 3/1990 | Moore | 210/219 |
| 4,961,400 | A | | 10/1990 | Lapray | 119/3 |
| 5,104,589 | A | * | 4/1992 | Palmer et al. | 261/120 |
| 5,116,501 | A | | 5/1992 | House | 210/242.2 |
| 5,330,639 | A | | 7/1994 | Murphree | 201/170 |
| 5,868,091 | A | | 2/1999 | Gross et al. | 114/61 |
| 5,948,326 | A | * | 9/1999 | Pate | 261/92 |
| 5,971,372 | A | | 10/1999 | Ash | 261/120 |
| 6,499,727 | B1 | * | 12/2002 | Sylvester | 261/92 |
| 2002/0063347 | A1 | * | 5/2002 | Lee et al. | 261/120 |
| 2003/0030157 | A1 | * | 2/2003 | Petrescu | 261/92 |

OTHER PUBLICATIONS

Brochure entitled "Consistency In Flow Patterns Allows for Consistency In Design" by S&N Airflo.
3 sheets Drawings: 1) 5300 Mammoth Rotor, Nov. 30, 1976 (No. 0420–5300–04); 2) Lagoon Master. Sep. 23, 1974 (No. 0400–5400–01); and 3) Lagoon Master Sep. 27, 1974 (No.0400–5400–02), by Passavant Corporation.
Brochure entitled "Wastewater Aeration Engineered for $O_2$ptimization" by Aeration Technologies International, Inc.
Printout of House Manufacturing Company, Inc.'s website (1998).
Brochure entitled "Loop. One Simple System For All Your Treatment Needs", by Smith & Loveless, Inc.
Website printouts for www.prosavvy.com and www.smith-andloveless.com.loop.htm.
Brochure entitled "Geddie's Quality Equipment for Catfish Producers" for Geddie's Machine & Repair Shop.
Various product descriptions for Passavant.
Webpage printout for House Manufacturing Company, Inc.—Municipal/Industrial Brush Aerators (pp.1–3) and MPW Chain Drive Aerator (pp.1–2).

* cited by examiner

*Primary Examiner*—C. Scott Bushey
(74) *Attorney, Agent, or Firm*—Kinney & Lange, P.A.

(57) ABSTRACT

The invention is a paddlewheel aerator having a support structure, a drive mechanism contained within the support structure, a rotatable shaft extending horizontally from the drive mechanism; and a plurality of paddlewheels surrounding the shaft. A plurality of support legs are formed integrally with the support structure. In a preferred embodiment, a watertight drive box is positioned within the support structure. The drive box has a removable cover and a substantially water tight seal for preventing ingress of water. The drive box contains a motor drivably connected to the shaft. The motor is contained within an upper portion of the drive box so that the motor is positioned at a vertically elevated level compared to the shaft.

20 Claims, 5 Drawing Sheets

HORIZONTAL SURFACE AERATOR

CROSS-REFERENCE TO RELATED APPLICATION(S)

None.

BACKGROUND OF THE INVENTION

The present invention relates generally to mechanisms for infusing air from the atmosphere into bodies of water, and more particularly to such mechanisms which are powered by a rotary engine or motor and are provided with a rotating paddlewheel with its paddles extending below the water line thereby producing sprays of large volumes of water which absorb air from the atmosphere before falling back into the body of water.

With the advent of relatively strict governmental controls regarding the pollution of the environment, including the pollution of the nation's water supply, sewage and wastewater treatment have become increasingly important. At one time it was customary for sewage to be dumped into any available water supply as a means of disposal. This practice is no longer tolerated. Now, sewage and other waste liquids must be treated before being released into a river or other water source.

Aeration is a widely used technique for treating a variety of fluids. For example, municipal water treatment plants, paper mills and drainage ponds all utilize aeration to continuously oxygenate and treat waste water. In wastewater treatment methods using aerobic or facultative waste stabilization lagoons, aeration of the wastewater is necessary to impart oxygen to the bacteria therein. These waste stabilization lagoons utilize aerobic and facultative bacteria to stabilize organic waste materials and clarify the water through consumption of organic matter. An adequate supply of oxygen to the body of water is essential in order for the bacteria to perform the stabilization function.

Aeration and mixing devices of various types are well known in the art. Known aeration systems include those which use air compressors to blow air into a waste stabilization lagoon, oxidation ditch, or equalization basin. However, these systems require extensive pipe work and labor-intensive monitoring and maintenance to prevent clogged air passages.

With waste water applications, the fluid to be aerated is maintained within one or more basins having large volume capacities, ranging from thousands to millions of gallons. Due to this large size, an aerator which can easily be moved to various locations within the basin is optimal. Float mounted aerators are designed to meet the aerating needs presented by large scale waste water holding basins.

One such float mounted aerator is described in U.S. Pat. No. 3,595,538 by Baumann, which discloses a liquid aerating paddlewheel rotor assembly which employs a support frame on which a rotor is rotationally mounted. The rotor rotates about a horizontal axis and has a plurality of mixing surfaces which lift, aerate, and mix the waste liquid. The rotor assembly is preferably mounted by a plurality of floats to float on top of the waste liquid. The rotor induces a flow in the liquid basin which provides for mixing of the liquid in conjunction with the aeration imparted to the liquid by the same rotor.

A number of problems are associated with the use of prior art aerators such as this one. First, in northern climates where the temperatures during the winter often fall below freezing for extended periods of time, it is not unusual for the surface of the basin to contain relatively large chunks of ice. In addition, it is also not unusual for wastewater basins to contain relatively large chunks of debris. The ice or other debris at the surface layer of liquid tends to jam the rotor. In extreme cases, this debris will break the rotor blades, thereby requiring replacement. The need to replace one or more rotor blades means that a certain amount of down time will be encountered during which the sewage treatment plant or process is inoperative. This down time can be significant in prior art designs in which each rotor blade is individually welded onto the axial shaft.

Moreover, it is important to be able to quickly and easily change the depth to which the paddleblades are immersed in the liquid in order to control the rate of aeration. In most prior art systems, such depth control requires specialized tools and involves a number of time consuming steps and adjustments.

Additionally, maintenance of the float mounted aerator, which most often takes place while the device is floating in a body of water, presents significant safety concerns. Normally, a maintenance worker is forced to either lean out of a boat to service the aerator, or attempt to balance on one of the rounded, slippery pontoons. Either approach is dangerous because of the possibility of slipping or falling. Thus, a design is needed which provides for ease of maintenance when the aerator is not floating in the water.

Moreover, the motor and drive mechanisms of prior art paddlewheel aerators are vulnerable to environmental damage by exposure to splashing water and debris. Thus, there exists a need for an efficient aerator which overcomes the disadvantages of prior art designs.

BRIEF SUMMARY OF THE INVENTION

The invention is a paddlewheel aerator comprising a support structure, a drive mechanism contained within the support structure, a rotatable shaft extending horizontally from the drive mechanism; and a plurality of paddlewheels surrounding the shaft. A plurality of support legs are formed integrally with the support structure. In a preferred embodiment, a watertight drive box is positioned within the support structure. The drive box has a removable cover and a substantially water tight seal for preventing ingress of water. The drive box contains a motor drivably connected to the shaft. The motor is contained within an upper portion of the drive box so that the motor is positioned at a vertically elevated level compared to the shaft.

DETAILED DESCRIPTION

Figure 1:
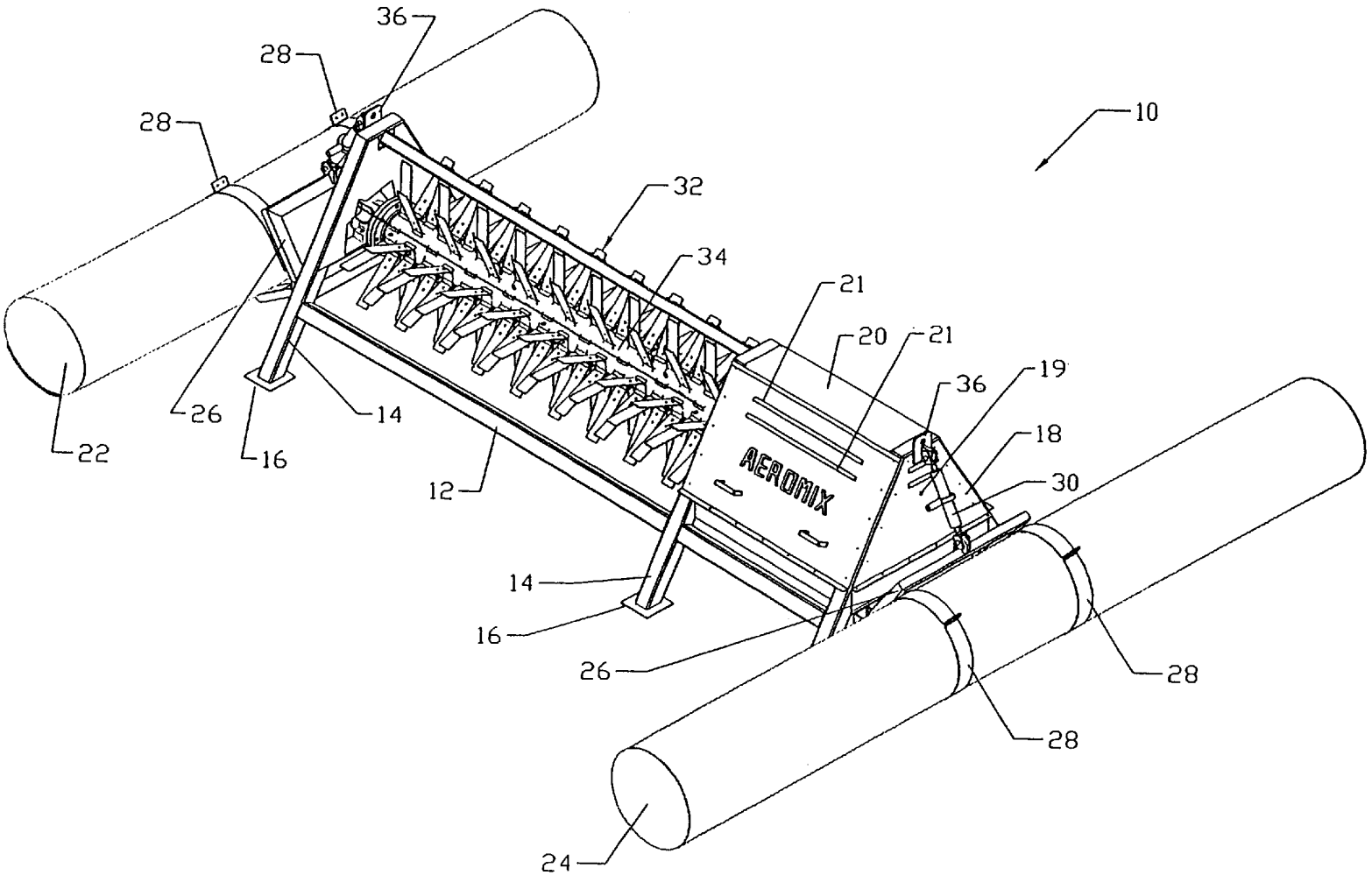
FIG. 1 is a perspective view of a preferred embodiment of an aerator of the present invention.

The present invention is a paddlewheel aerator that mechanically aerates facultative waste stabilization lagoons, oxidation ditches, equalization basins, commercial catfish ponds, and similar bodies of water. FIG. 1 is a perspective view of a preferred embodiment of aerator 10 of the present invention. Aerator 10 includes support structure or frame 12 with integral legs 14 terminating in feet 16, watertight drive box 18 with aperture 19, removable drive box cover 20 with vents 21, pontoon 22, pontoon 24, pontoon brackets 26, securing straps 28, jack screw 30, paddlewheel 32, torque tube 34, and cable guides 36. In a preferred embodiment, frame 12 is about 14 feet long, about 6 feet deep, and about 5 feet high. With pontoons 22 and 24, aerator 10 is about 19 feet long, about 17 feet deep, and about 5 feet high. However, aerator 10 may be constructed at any size suitable for a particular application.

Aerator 10 is preferably constructed of stainless steel because of its strength and corrosion resistance. Integral legs 14 of frame 12 support aerator 10 on land and in low water situations. A problem encountered by prior art aerators which do not have legs 14 is that contact between the pontoons or paddlewheel blades and a ground surface occurs in shallow water or on land. Because these parts are not designed to bear the weight of the aerator, such contact can cause damage such as punctures in the pontoons or bending of the paddlewheel blades. Additionally, contact from sharp parts of the aerator may puncture or damage a lining of a wastewater basin.

In addition to protecting aerator 10 and a wastewater basin from damage, an advantage of integral legs 14 is that they allow an operator to service aerator 10 on land. This is in contrast to prior art aerators which must be serviced while floating, which can be dangerous and difficult. Legs 14 allow aerator 10 to rest on a dry surface without damage to pontoons 22 or 24 or paddlewheels 32. Feet 16 are further provided at a lower terminus of each leg 14 to provide stability and prevent damage to the surface on which aerator 10 rests. In addition to easier field maintenance and repair, legs 14 also increase the ease with which aerator 10 may be built or assembled.

Drive box 18 is positioned within frame 12 and contains the mechanisms which drive torque tube 34, and therefore paddlewheel 32, creating water turbulence and thereby aerating the liquid in which aerator 10 floats. Drive box 18 includes aperture 19 for the passage of an electrical motor cable or wire (not shown) which powers the mechanisms which drive torque tube 34. These mechanisms will be further described with reference to FIG. 2. Drive box 18 is covered by removable drive box cover 20 to protect the drive mechanisms from environmental exposure and damage, such as from excessive moisture. A substantially water-tight seal is provided at the interface between cover 20 and frame 12 to prevent ingress of water to the interior of drive box 18. Cover 20 may include shielded vents 21 to allow heat and moisture to escape, while preventing water infiltration.

Aerator 10 floats in a liquid upon floatation devices such as pontoons 22 and 24. Pontoons 22 and 24 are standard flotation devices, preferably comprising a sealed hollow or foam-filled stainless-steel shell. In a preferred embodiment, pontoon 24 may be larger than pontoon 22 to provide sufficient buoyancy to balance the weight of each side of aerator 10. Pontoons 22 and 24 are secured by straps 28 with quick-release pins to adjustable brackets 26. Brackets 26 are attached to frame 12 by jack screws 30, which allow for quick and easy adjustment of the vertical position of pontoons 22 and 24.

Paddlewheels 32 preferably comprise a plurality of double reinforced paddle blades surrounding and bolted onto torque tube 34. The configuration of paddlewheel 32 will be further described with reference to FIGS. 4, 5A, and 5B. Frame 12 preferably includes cable guides 36, which allow for the attachment of cables which can be used to control the movement or mooring of aerator 10.

Figure 2:
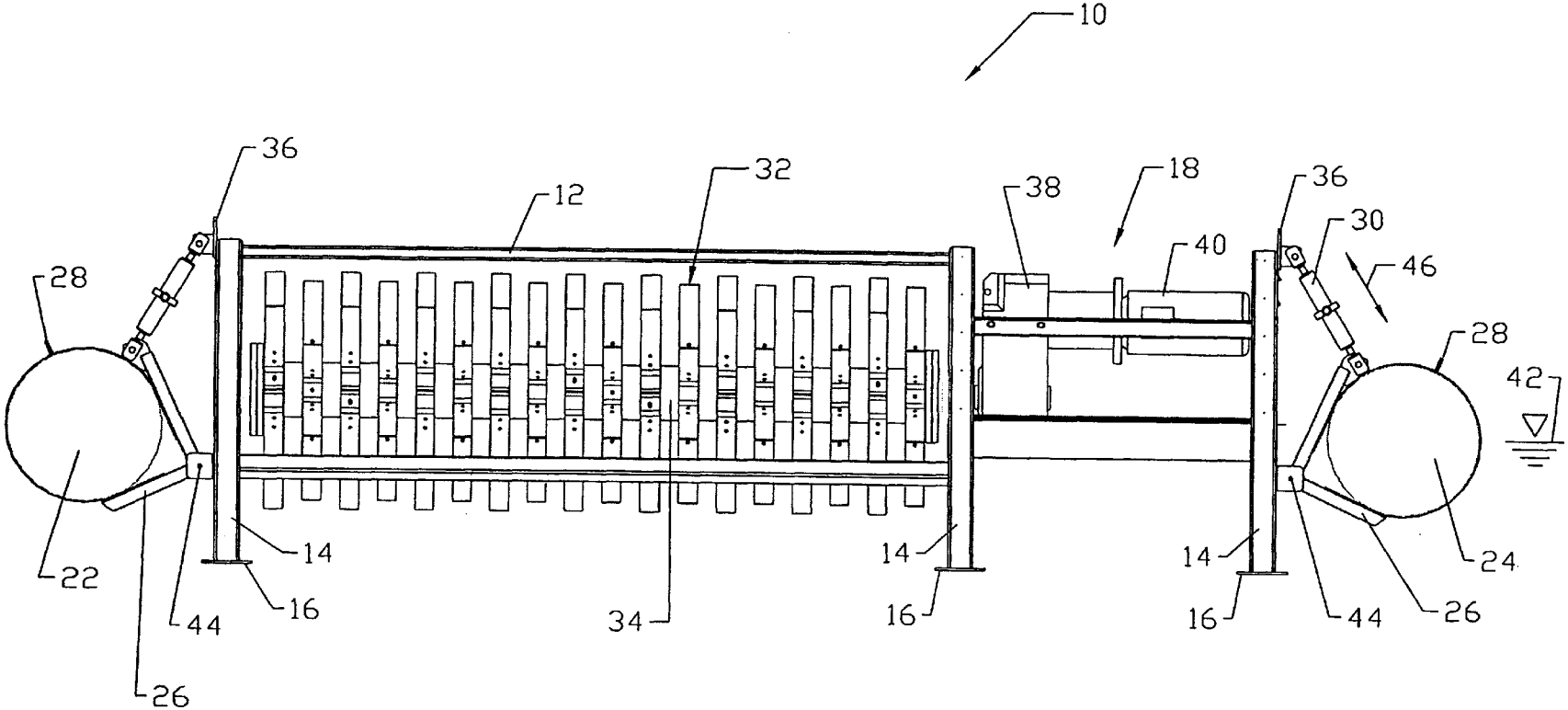
FIG. 2 is an elevation view of the aerator of FIG. 1 with the drive box cover removed.

FIG. 2 is an elevation view of aerator 10 with drive box cover 20 removed. FIG. 2 additionally shows speed reduction gear mechanism 38 and motor 40 within drive box 18, water level 42, bracket plate 44, and adjustment direction 46 of jack screw 30. As seen in FIG. 2, the blades of paddlewheels 32 extend well below water line 42. As paddlewheels 32 rotate into and out of the water, the scooping and mixing action imparted by paddlewheels 32 breaks the water droplets into a fine mist which combines with atmospheric air, thereby generating high levels of oxygen transfer. The horizontal pumping action of paddlewheels 32 pushes the aerated water out into the basin while drawing up water low in dissolved oxygen from deep within the basin and from behind aerator 10, providing for efficient mixing.

Speed reduction gear drive mechanism 38 is known in the art. Such a mechanism is necessary because readily available motors typically have rotational motor speeds which are much higher than the optimal rotation speed of paddlewheels 32. Preferably, the rotational speed of paddlewheel 32 is about $1/100$ to about $1/20$ of the motor speed. Most preferably, the reduction ratio is about $1/29$. Gear mechanism 38 drivably connects motor 40 and torque tube 34. In a preferred embodiment, torque tube 34 and paddlewheels 32 turn at about 40 to about 80 RPM (rotations per minute), and most preferably at about 50 to about 60 RPM.

The unique configuration of frame 12 positions motor 40 at an upper portion of drive box 18, well above water level 42. Motor 40 is preferably positioned at a vertically elevated level compared with the level of torque tube 34. Although the interface between cover 20 and frame 12 is preferably completely sealed with a marine gasket seal to prevent water infiltration, this positioning of motor 40 protects motor 40 from possible damage caused by any water that might seep into drive box 18.

Motor 40 is preferably an electric motor powered by an off site source (not shown) directing a current supply through wiring (not shown) to motor 40. Other forms of powering aerator 10 are acceptable, such as a battery. The size of motor 40 will vary according to the needs of a particular waste water treatment application. For example, motor 40 can range in size from one horse power to one hundred horse power. Preferably, motor 40 is a fifteen horsepower electric motor.

In a preferred embodiment, each pontoon bracket 26 comprises a pair of perpendicularly oriented plates, pivotally pinned to frame 12 at bracket plate 44. Jack screw 30 is pivotally connected to bracket 26 at a lower end of jack screw 30, and to cable guide 36 at an upper end of jack screw 30. A suitable jack screw 30 is a push-pull ratchet type jack screw. An adjustment of jack screw 30 in either the upward or downward direction indicated by arrow 46 causes bracket 26 to pivot about the pin secured to bracket plate 44, thereby vertically raising or lowering pontoons 22 and 24 relative to frame 12. This adjustment allows an operator, without the use of additional tools, to quickly and easily adjust the depth to which paddlewheels 32 reach into the liquid to be aerated. An operator controls the oxygen transfer rate of aerator 10 by changing the extent of immersion and the speed of rotation of paddlewheels 32; the greater the extent of immersion and the faster the rotational speed, the higher the rate of oxygen transfer.

Figure 3:
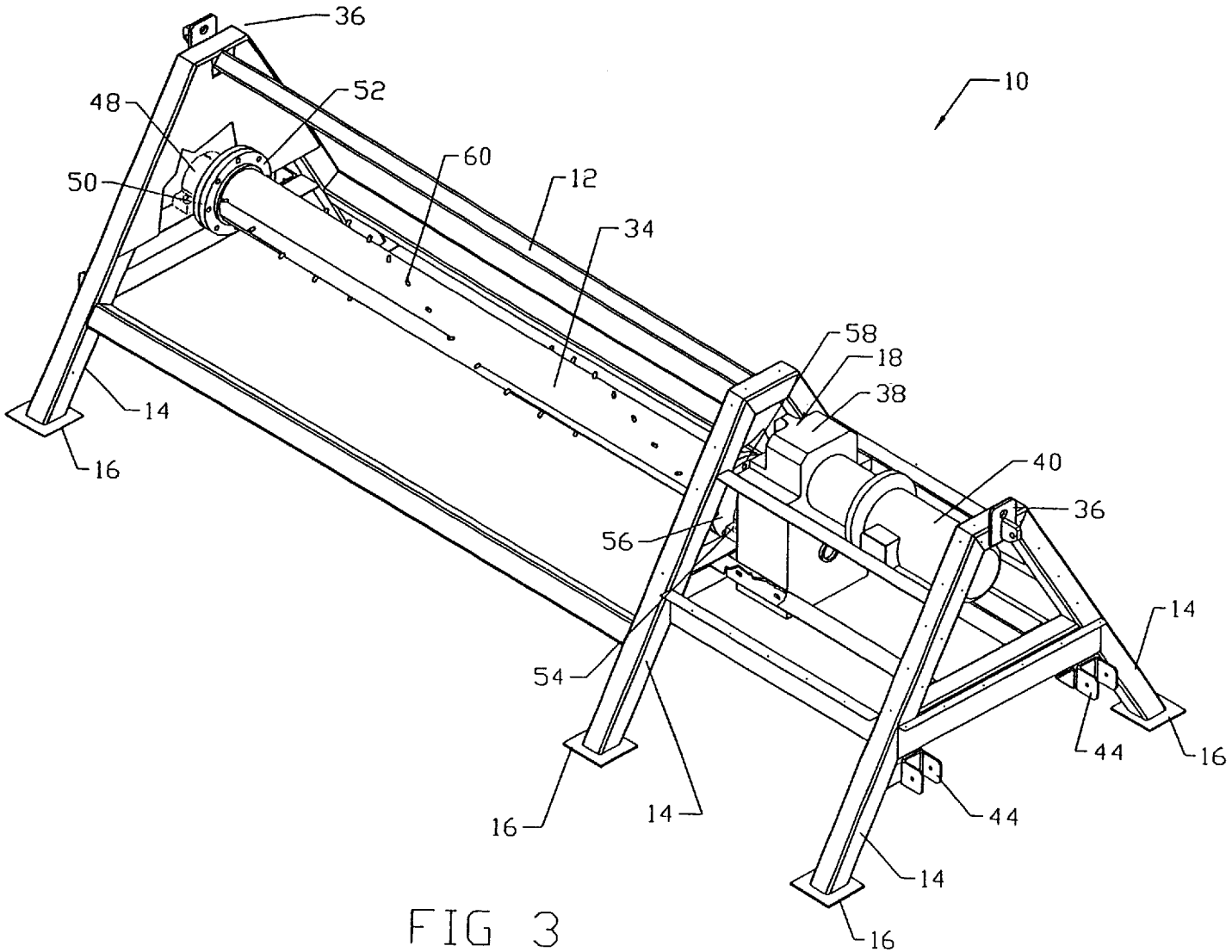
FIG. 3 is a perspective view of the aerator of FIG. 1 with the pontoons, drive box cover, and paddlewheels removed.

FIG. 3 is a perspective view of aerator frame 12, gear mechanism 38, motor 40, and torque tube or shaft 34. FIG. 3 further shows bearing 48, shaft end 50, driven flange 52, bearing 54, shaft end 56, driving flange 58, and studs 60.

Bearing 48 is bolted onto frame 12, and shaft end 50 is inserted therein. Bearing 48 supports shaft end 50, which is fixedly attached to torque tube 34. Torque tube 34 is preferably an eight inch diameter S10 pipe. A lip seal seals the interface between bearing 48 and shaft end 50. In a preferred embodiment, a self-aligning, expansion-type, tapered roller pillow block bearing 48 is chosen because of its self aligning capabilities, ability to absorb axial loads, and durability compared to other types of bearings, such as plastic sleeve bearings. Both bearings 48 and 54 are preferably equipped with autolubers, which eliminate maintenance for long periods of time.

Driven flange 52 of torque tube 34 is bolted onto shaft end 50. Similarly, at the opposite end of torque tube 34, bearing 54 is bolted onto frame 12, receives shaft end 56, and includes a lip seal between bearing 54 and shaft end 56. Bearing 54 is optionally the same type of bearing as bearing 48. Alternatively, a tapered roller bearing 54 may be used, or bearing 54 may be eliminated completely, especially if gear mechanism 38 is equipped with an adequate bearing. In any case, the interface between shaft end 56 and bearing 54 or gear mechanism 38 is sealed against water and contaminant infiltration. Shaft end 56 is similarly bolted to driving flange 58 of torque tube 34 so that shaft end 56 and torque tube 34 extend horizontally from gear mechanism 38 and are drivably connected to gear mechanism 38.

Torque tube 34 is preferably fitted with eighteen pairs of diametrically opposed studs 60, for a total of thirty six studs 60, upon which paddlewheels 32 are removably mounted. Each of the pair of studs 60 is positioned on diametrically opposing sides of torque tube 34. Each pair of studs 60 are preferably spaced in a staggered arrangement, as shown in FIG. 3, to prevent pulsing shock loads on gear mechanism 38. In a preferred embodiment, adjacent sets of studs 60 are circumferentially displaced about 22.5 degrees from each other.

Figure 4:
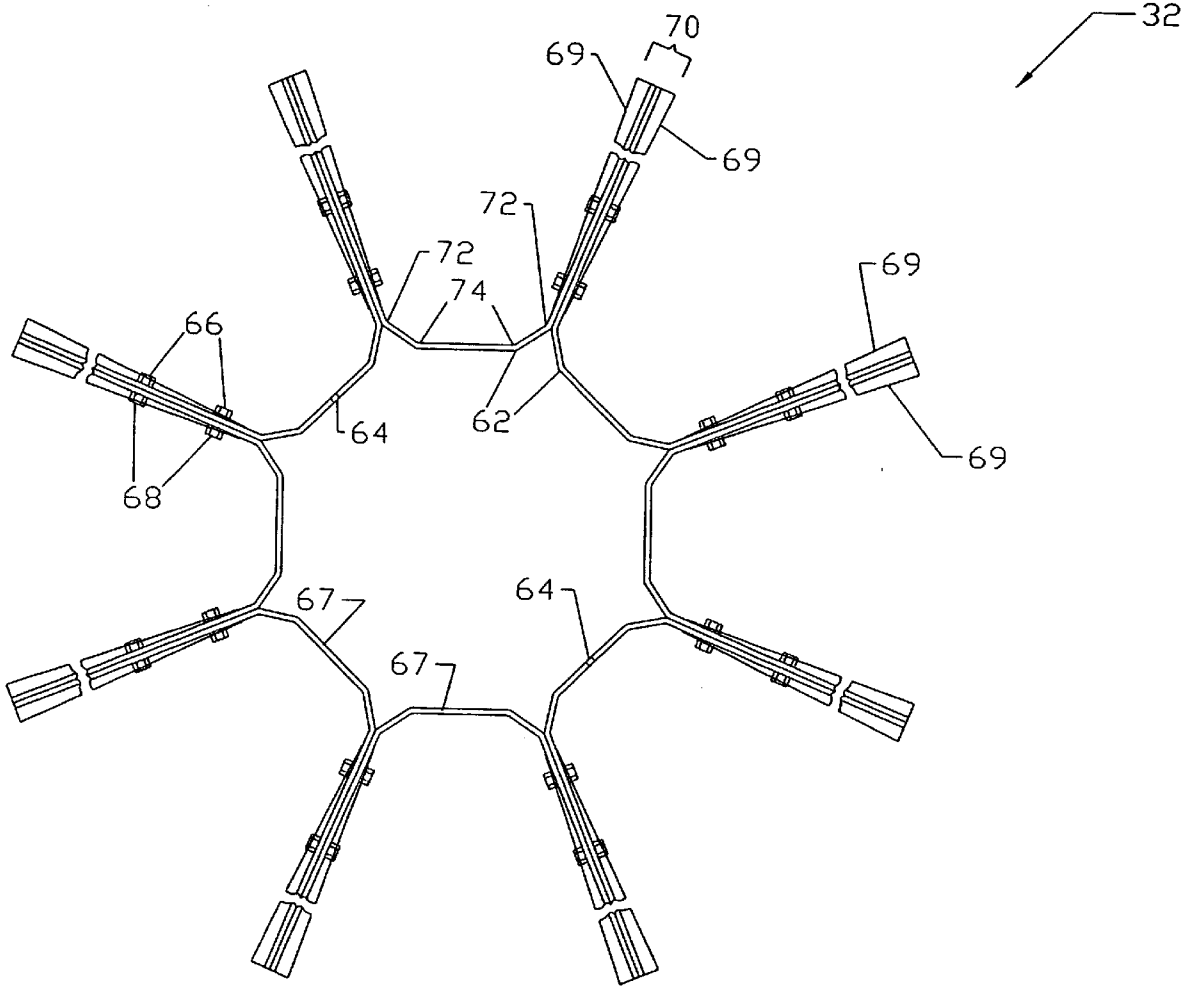
FIG. 4 is a side elevation view of a paddlewheel of the present invention.

FIG. 4 is a side elevation view of a paddlewheel 32. FIG. 4 illustrates that paddlewheel 32 is formed from a plurality of U-shaped paddle blades 62 having stud holes 64 and bolt holes 66. For purposes of illustration, each blade 62 has had a length section "broken away" so that the hub of paddlewheel 32 is enlarged. Each blade 62 has base section 67 and two radially extending legs 69, the legs 69 being of substantially equal length. In a preferred embodiment, about one quarter of blades 62 have stud hole 64, and about three quarters of blades 62 do not have stud hole 64. The two of eight blades 62 with stud hole 64 are mounted at diametrically opposing sides of paddlewheel 32, so that they correspond with studs 60 on torque tube 34. Each stud hole 64 receives a stud 60 (as seen in FIG. 3). Bolts or nuts and washers (not shown) lock onto each stud 60 to secure blades 62 to torque tube 34, thereby preventing rotation of paddle wheels 32 about torque tube 34 (seen in FIG. 3). In a preferred embodiment, individual paddle blades 62 are removably secured to each other by bolts 68 through bolt holes 66. An advantage of this design is that each paddle 70 is double-reinforced in that it comprises two bolted legs 69. This lends increased strength to paddles 70.

Additionally, in this design, both sides of each paddle 70 are identical. Therefore, paddlewheel 32 may be mounted on torque tube 34 in any direction. Thus, an operator need not be worried about the rotational direction of torque tube 34 when mounting paddlewheel 32. Another advantage of constructing paddlewheel 32 from a plurality of bolted blades 62 is that each blade 62 is individually replaceable. Thus, if one blade 62 breaks or is otherwise damaged, an operator may unbolt and replace just that blade 62, without having to replace the entire paddlewheel assembly 32. This allows for a much easier, quicker, and less-expensive repair than would otherwise be necessary. In a preferred embodiment, each blade 62 includes U-bends 72 of about 146° and U-bends 74 of about 146°.

Figure 5B:
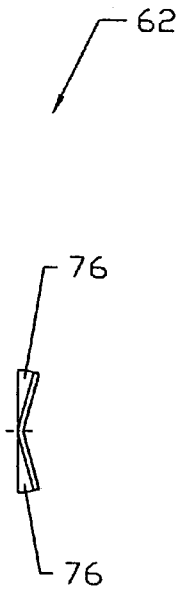
FIG. 5B is an end elevation view of the paddle blade of FIG. 5A.
Figure 5A:
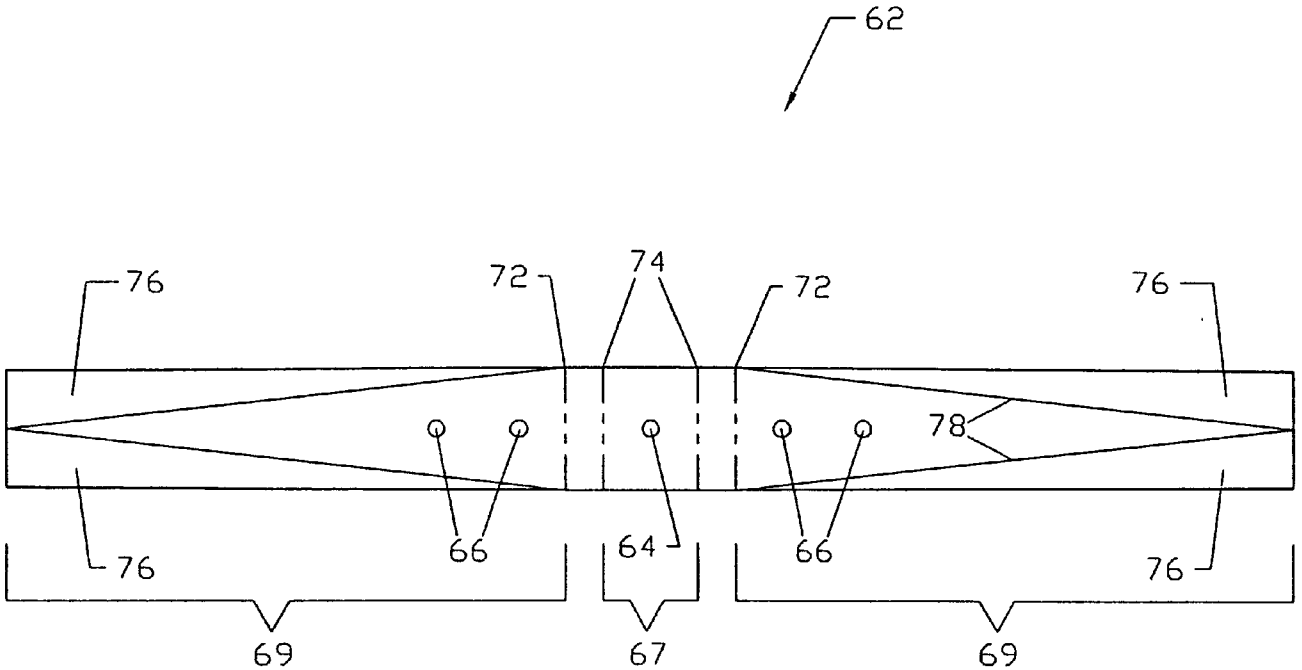
FIG. 5A is a top view of a paddle blade of the present invention.

FIG. 5A is a top view of a blade 62 of FIG. 4 before fashioning U-bends 72 and 74. Each blade 62 is preferably about 3 inches wide and about 31 inches long. When folded into a "U" shape, as shown in FIG. 4, each leg of blade 62 is preferably about 14 inches long. FIG. 5B illustrates an end elevation view of blade 62 of FIG. 5A. FIGS. 5A and 5B illustrate upturned fins 76 formed by bending blades 62 at bend lines 78. Bend line 78 extends from an outside edge of blade 62 at bend line 72 to the midpoint of the terminus of blade 62. Fins 76 help blades 62 scoop up more liquid, thereby imparting increased turbulence to the body of water or liquid being aerated. This allows for increased contact between the water and the atmosphere and increases aeration efficiency. The preferred bend angle of fins 76 is about 15 degrees.

Although the present invention has been described with reference to preferred embodiments, workers skilled in the art will recognize that changes may be made in form and detail without departing from the spirit and scope of the invention.

What is claimed is:

1. A paddlewheel aerator comprising:

a support structure;

a drive box having a removable cover positioned on the support structure;

a rotatable shaft extending horizontally from the drive box;

a plurality of paddlewheels surrounding the shaft;

a motor drivably connected to the shaft, the motor contained within the drive box;

a floatation device connected to the support structure; and a jack screw disposed at a connection of the floatation device and the support structure so that adjustment of the jack screw changes a vertical position of the floatation device relative to the support structure.

2. The aerator of claim 1 further comprising a speed reduction gear mechanism contained within the drive box, the gear mechanism being intermediate the motor and the rotatable shaft.

3. The aerator of claim further comprising a vent disposed in the cover.

4. The aerator of claim 1 further comprising a cable guide disposed on the support structure.

5. The aerator of claim 1 in which the floatation device comprises a foam-filled pontoon.

6. The aerator of claim 1 further comprising a pivotable bracket which connects the floatation device to the support structure so that a change in the vertical position of the floatation device relative to the support structure is accomplished by pivoting the bracket about a pivot point on the support structure.

7. The aerator of claim 1 in which the drive box has a substantially water tight seal for preventing ingress of water to an interior of the drive box.

8. The aerator of claim 1 in which the motor is contained within an upper portion of the drive box so that the motor is positioned at a vertically elevated level compared to the shaft.

9. A paddlewheel aerator comprising:

a support structure;

a drive box positioned on the support structure;

a rotatable shaft extending horizontally from the drive box;

a plurality of paddlewheels surrounding the shaft, in which each paddlewheel comprises a plurality of U-shaped blades, each blade having two radially extending legs of substantially equal length, in which each leg of a blade is removably fastened to a leg of an adjacent blade; and a motor drivably connected to the shaft.

10. The aerator of claim 9 which the drive box has a removable cover and a substantially water tight seal for preventing ingress of water to an interior of the drive box.

11. The aerator of claim 9 in which the motor is contained within an upper portion of the drive box so that the motor is positioned at a vertically elevated level compared to the shaft.

12. A paddlewheel aerator comprising:

a support structure;

a drive box positioned on the support structure;

a rotatable shaft extending horizontally from the drive box;

a plurality of paddlewheels surrounding the shaft;

a motor drivably connected to the shaft; and a plurality of studs disposed on the shaft for removable attachment of the plurality of paddlewheels to the shaft.

13. The aerator of claim 12 in which each of a pair of studs is positioned on diametrically opposing sides of the shaft for the attachment of each paddlewheel.

14. The aerator of claim 12 in which each pair of studs is circumferentially displaced relative to an adjacent pair of studs.

15. The aerator of claim 12 in which the drive box has a removable cover and a substantially water tight seal for preventing ingress of water to an interior of the drive box.

16. The aerator of claim 12 in which the motor is contained within an upper portion of the drive box so that the motor is positioned at a vertically elevated level compared to the shaft.

17. A paddlewheel aerator comprising:

a support structure comprising a plurality of support legs formed integrally with the support structure;

a drive mechanism disposed on the support structure;

a rotatable shaft extending horizontally from the drive mechanism the drive mechanism contained within a drive box, the drive box having a removable cover;

a plurality of paddlewheels surrounding the shaft;

a floatation device connected to the support structure; and a jack screw dispose at a connection of the floatation device and the support structure so that adjustment of the jack screw changes a vertical position of the floatation device relative to the support structure.

18. The aerator of claim 17 further comprising a plurality of feet so that a foot is attached to a lower terminus of each leg.

19. The aerator of claim 17 wherein the drive box is a watertight drive box positioned within the support structure, the drive box having a substantially water tight seal for preventing ingress of water to an interior of the drive box.

20. The aerator of claim 17 in which the drive mechanism comprises a speed reduction gear mechanism and a motor.

* * * * *

UNITED STATES PATENT AND TRADEMARK OFFICE

CERTIFICATE OF CORRECTION

PATENT NO. : 6,634,626 B2
DATED : October 21, 2003
INVENTOR(S) : Catalin Petrescu et al.

It is certified that error appears in the above-identified patent and that said Letters Patent is hereby corrected as shown below:

Column 6,
Line 53, after "claim" insert -- 1 --

Column 7,
Line 17, after "claim 9" insert -- in --

Signed and Sealed this

Twenty-seventh Day of January, 2004

JON W. DUDAS
*Acting Director of the United States Patent and Trademark Office*